United States Patent [19]

Röck et al.

[11] Patent Number: 4,686,769

[45] Date of Patent: Aug. 18, 1987

[54] MARKING GAUGE FOR USE IN MOUNTING HINGES

[75] Inventors: Erich Röck, Höchst; Helmut Rupprechter, Lauterach, both of Austria

[73] Assignee: Julius Blum Gesellschaft m.b.H., Höchst, Austria

[21] Appl. No.: 877,792

[22] Filed: Jun. 24, 1986

[30] Foreign Application Priority Data

Jul. 8, 1985 [AT] Austria ..... 2012/85

[51] Int. Cl.[4] ..... B27G 17/08

[52] U.S. Cl. ..... 33/197; 33/562; 33/613; 33/574

[58] Field of Search ..... 33/194, 197, 189, 180 R, 33/562

[56] References Cited

U.S. PATENT DOCUMENTS

| | | | |
|---|---|---|---|
| 2,634,507 | 4/1953 | Boatwright | 33/197 |
| 3,406,460 | 10/1968 | Colwell | 33/189 |
| 4,033,044 | 7/1977 | Michaels | 33/180 A X |

FOREIGN PATENT DOCUMENTS

| | | | |
|---|---|---|---|
| 82139 | 2/1957 | Denmark | 33/197 |

*Primary Examiner*—Harry N. Haroian

*Attorney, Agent, or Firm*—Wenderoth, Lind & Ponack

[57] ABSTRACT

A marking gauge the allows exact drilling of the fastening holes for a mounting plate of a hinge and for a hinge casing. The marking gauge has an open slot at its rear and a screw in its center. The marking gauge is thus engageable on the mounting plate, and a bore for the hinge casing can be marked at a recess. When reversed, the marking gauge is insertable into a bore for the hinge casing so that the bores for the mounting plate can be marked.

15 Claims, 22 Drawing Figures

MARKING GAUGE FOR USE IN MOUNTING HINGES

SUMMARY OF THE INVENTION

The invention relates to a marking gauge for use in mounting hinges, and including positioning or locating means and marking means.

It is the object of the invention to provide a marking gauge of the afore-mentioned kind which makes it easier for an operator or furniture assembler to locate the bores for the mounting plate of the hinge arm and the bore or bores for the hinge casing precisely with respect to one another.

According to the invention this is achieved in that the marking means comprise at least one recess and that the locating means comprise holding elements by means of which the marking gauge is engageable with a mounting plate of a hinge arm and/or into a bore for a hinge casing.

It is advantageously provided that the marking gauge has an open or keyhole-like slot as well as a bolt with a head whose diameter is greater than that the adjoining bolt portion, the bolt advantageously being formed by a screw which is mounted in a female thread in the marking gauge.

A marking gauge of the afore-mentioned kind is adapted to be engaged in a mounting plate, as shown for example in Swiss Patent No. 609.417.

An embodiment of the invention provides that the marking gauge is plate-shaped and has, substantially in its center, a projecting flange member. When the bores are being marked, the flange member abuts at the front of the furniture side wall and, hence, locates the position of the bores in the direction of the depth of the article of furniture.

A further embodiment of the invention provides that prick or marking punches are held in the recesses. In this embodiment of the marking gauge the operator or furniture assembler needs no pencil. The necessary markings can be made directly by pressing the punches and making marks thereby.

Another embodiment of the invention provides that the recesses have funnel-shaped side walls, the side walls being advantageously subdivided into sectors. The funnel-shaped side walls facilitate marking by means of a pencil or the like.

In a further embodiment, opposed funnel-shaped recesses are provided. Such recesses serve, on the one hand, to mark the bores for the mounting plate and, on the other hand, to locate the bore for the hinge casing in the furniture door.

It is advantageously provided that the recesses are circular.

A further embodiment of the invention provides that flange members project from the side remote from the bolt and corresponding to the bore for a hinge casing. When the bore for the hinge casing at the side of the furniture door has been drilled first, such flange members be inserted into the bore and then be positioned at the furniture side wall. It is thus possible to mark the bores for the mounting plate, such bores being already precisely aligned with respect to the bore for the hinge casing which has already been made. The flange members are advantageously arc-shaped and describe only a part of the bore wall.

A further embodiment of the invention provides that flange members forming guides for the mounting plate are provided at opposite sides of the bolt.

It is advantageously provided that the slot is positioned in a narrower portion of the marking gauge.

BRIEF DESCRIPTION OF THE DRAWINGS

Below various embodiments of the invention will be described in more detail with reference to the accompanying drawings, in which.

DETAILED DESCRIPTION OF THE INVENTION

Figure 21:
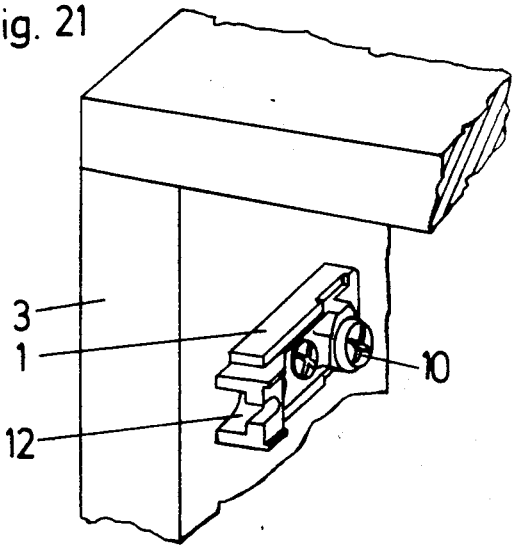
FIG. 21 is a perspective schematic view of a mounting plate whose fastening holes can be marked by means of the marking gauge according to the invention.
Figure 13:
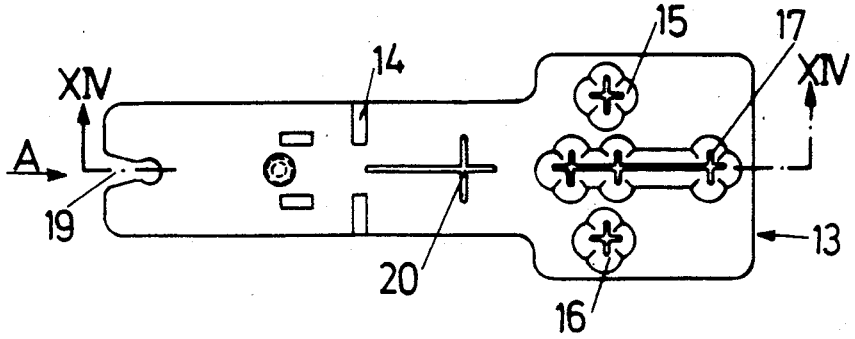
FIG. 13 is a top view of an embodiment of the marking gauge according to the invention as shown in FIGS. 1 to 3.
Figure 14:
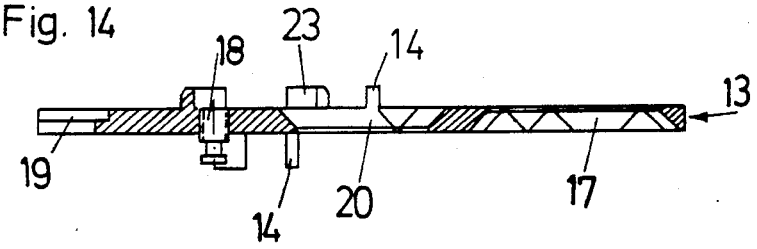
FIG. 14 is a sectional view along line XIV—XIV of FIG. 13.
Figure 15:
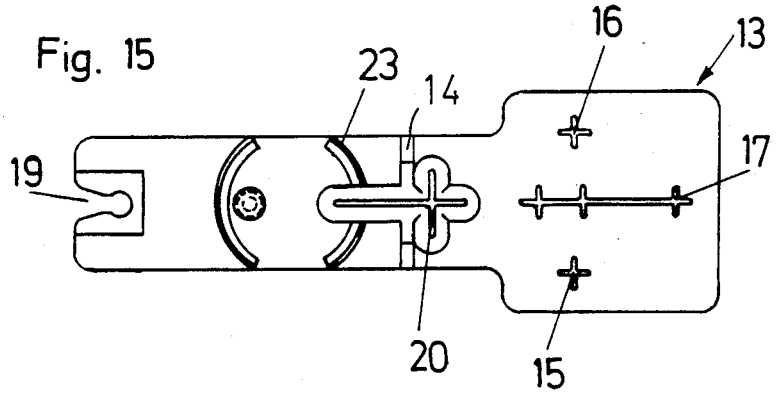
FIG. 15 is a top view of the opposite side of the marking gauge.
Figure 16:
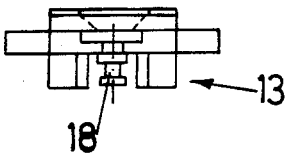
FIG. 16 is a view from the direction of arrow A of FIG. 13, FIGS. 17 to 20 are views of a further embodiment of the marking gauge similar to FIGS. 13 to 16, respectively, the marking gauge being provided with prick punches.
Figure 17:
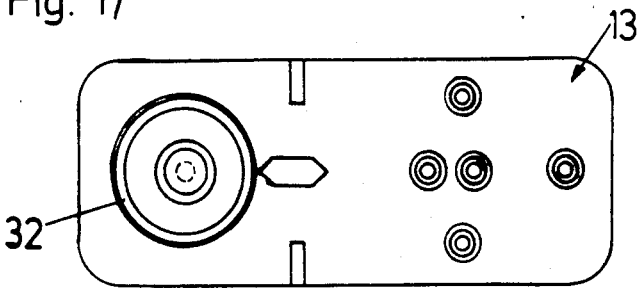
Figure 18:
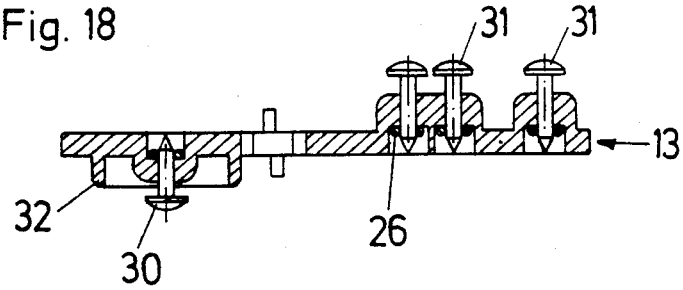
Figure 19:
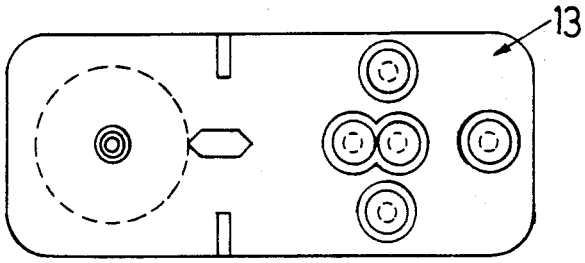
Figure 20:
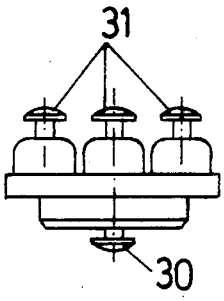
Figure 22:
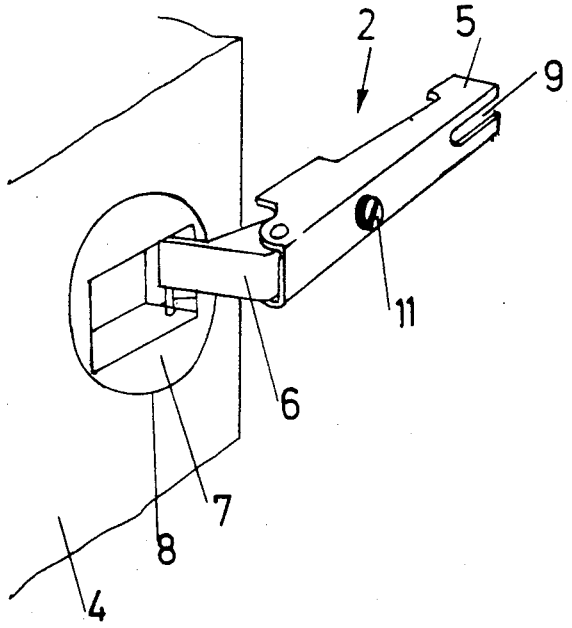
FIG. 22 is a perspective view of an associated hinge.

As can be seen from FIGS. 21 and 22, and as known by those skilled in the art, a mounting plate 1 and a hinge 2 are mounted separately, i.e. respectively at a side wall 3 of an article of furniture and at a door 4 of the article of furniture, and the door 4 is mounted on plural mounting plates 1 by means of plural hinge arms 5.

The hinge arms 5 is, by means of hinge links 6, connected with a hinge casing 7 which is inserted into a bore 8 in the door 4 of the article of furniture.

The hinge arm 5 has at a rear end thereof an open slot 9 by means of which the hinge arm is insertable beneath a fastening screw 10 of the mounting plate 1. At a front end thereof, the hinge arm 5 has a screw 11 which serves as a joint adjustment screw which has a head which is pushed into a recess 12 of the mounting plate 1 during the mounting operation. Because a door 4 is held by a number of hinges 2, it is absolutely necessary that the positions of the hinges 2 and of the mounting plates 1 are correct with respect to one another and, hence, that the corresponding fastening holes have been correctly drilled.

Figure 1:
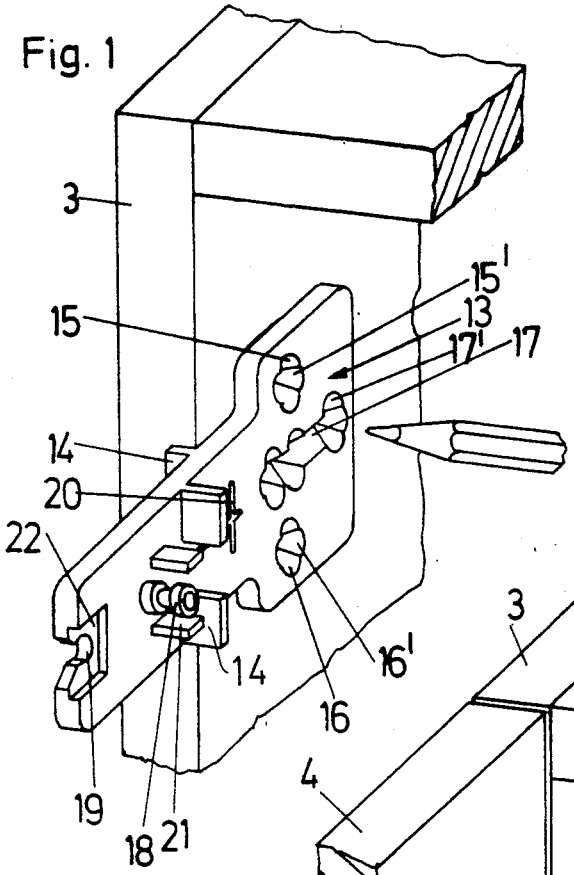
FIG. 1 is a perspective schematic view of a marking gauge according to the invention in the process of being employed for marking bores of a mounting plate, a bore for a hinge casing not yet having been provided in a door.

FIG. 1 shows the marking of the bores for the mounting plate 1, when there is not yet a bore 8 in the door 4.

A marking gauge 13 is positioned at the furniture side wall 3 at the height at which the mounting plate 1 is desired. Gauge 13 has extending from opposite sides thereof respective flange members 14. In this position, the marking gauge 13 abuts with one flange member 14 at the front of the furniture side wall 3. Recesses 15, 16 and 17 each define crosses which can be marked by means of a pencil or the like.

Figure 3:
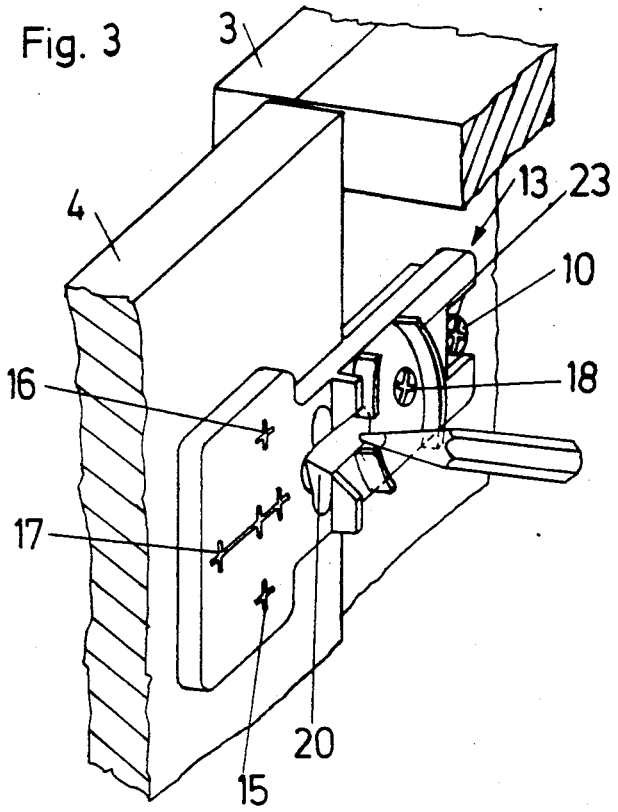
FIG. 3 is a similar schematic view of the marking gauge according to FIGS. 1 and 2, when positioned at a mounting plate which has already been mounted, and when marking the fastening holes or the fastening hole for the hinge casing at the door of the article of furniture.

FIG. 3 shows the rear of the marking gauge 13, and this figure shows the cruciform contours of the recesses 15, 16,17.

As can be seen in FIG. 1, the recesses 15,16,17 are funnel-shaped, which facilitates the marking operation. The side walls have funneled sectors 15',16',17'.

When the fastening holes for the mounting plate 1 have been marked by means of the marking gauge 13 according to FIG. 1, the mounting plate 1 is mounted at the furniture side wall 3. Then the marking gauge 13 is reversed and, as can be seen in FIG. 3, pushed onto the mounting plate 1. In this position, a screw 18 of the marking gauge 13 projects with its head into the recess 12 of the mounting plate 1, and an open slot 19 of marking gauge 13 embraces the screw 10.

Therefore, the marking gauge 13 can, like the hinge arm shown in FIG. 22, be pushed onto the mounting plate 1.

Then the door 4 is positioned at the marking gauge 13, and the bore 8 for the hinge casing 7 is marked at a recess or opening 20 in marking gauge 13.

Flange members 21 which may serve as lateral guides for the mounting plate 1 are provided at opposite sides of the screw 18.

As can be seen in FIGS. 1 and 3, the slot 19 is arranged in a narrower portion 22 of the marking gauge 13 so that the marking gauge 13 can be aligned exactly parallel to the furniture side wall 3.

Figure 2:
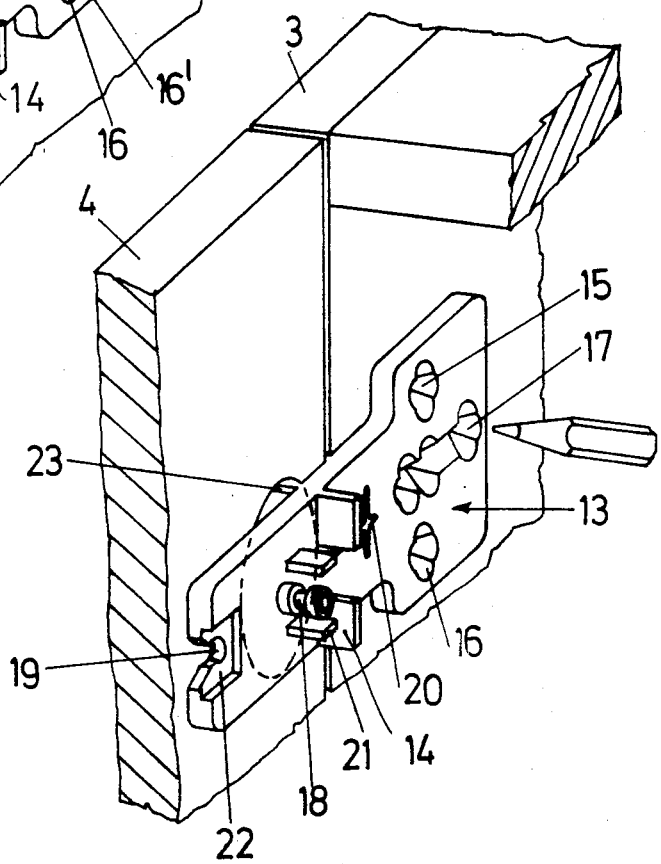
FIG. 2 is a similar schematic view of the same marking gauge in the process of being employed for marking the bores for the mounting plate, with a bore for the hinge casing already having been provided in the door.

When the bore 8 in the door 4 has been drilled first, then as can be seen in FIG. 2 flange members 23 of marking gauge 13 are inserted into the bore 8. Then the door 4 with the marking gauge 13 is positioned at the furniture side wall 3, and the bores for the chosen mounting plate 1 can be marked through the recesses or openings 15,16,17.

Figure 4:
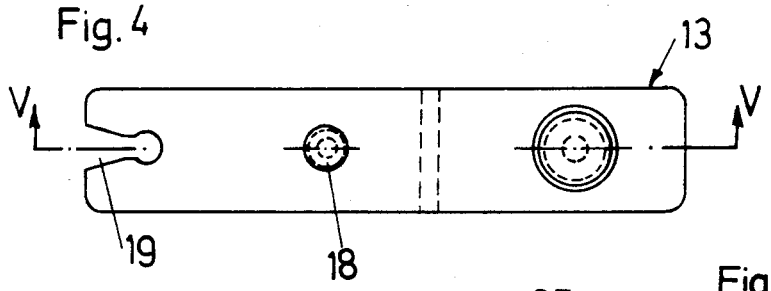
FIG. 4 is a top view of a simplified form of the marking gauge which is only suited for marking the bore for the hinge casing.
Figure 5:
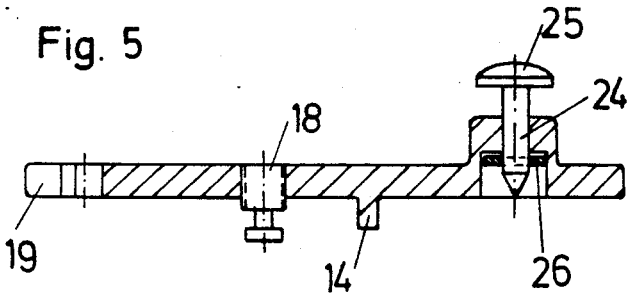
FIG. 5 is a sectional view along line V—V of FIG. 4.
Figure 6:
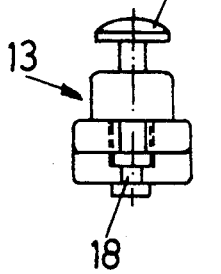
FIG. 6 is an end view of the marking gauge according to FIG. 4, FIGS. 7 to 9 and 10 to 12 are views similar to FIGS. 4 to 6, respectively, but of two further embodiments of the marking gauge according to the invention, each of such embodiments being only suited for marking the bore for the hinge casing.

FIGS. 4 to 6 show a simplified form of the marking gauge 13. Identical features are the open slot 19, the screw 18 and the flange member 14 which abuts at the front of the side wall 3 and/or of the door 4 during the mounting operation. A prick or marking punch 25 is held in a recess 24. The means of said prick punch 25 the bore 8 for the hinge casing 7 can be marked by pressing inwardly the punch 25.

The prick punch 25 is held in place by a security ring or retainer 26.

For marking bore 8, the marking gauge 13 is, as in the afore-described embodiment, engaged in the mounting plate by means of the screw 8 and the open slot 19. Then, the door 4 is positioned at the marking gauge 13, as can be seen in FIG. 3, and the bore is marked by striking the prick punch 25.

Figure 7:
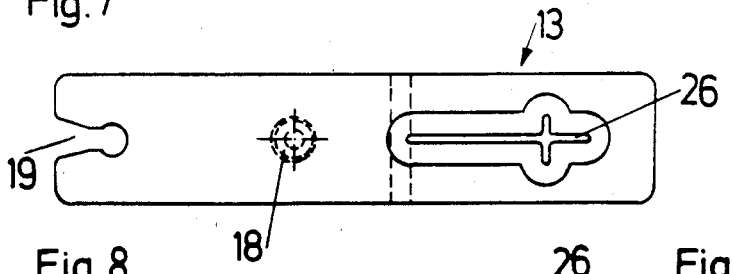
Figure 8:
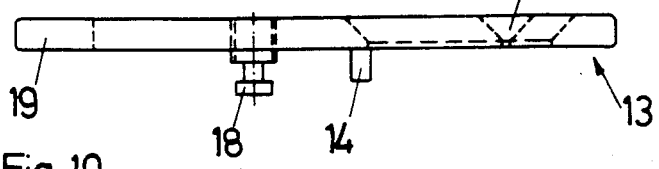
Figure 9:
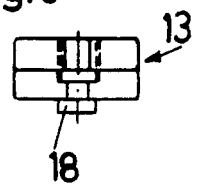

FIGS. 7 to 9 show substantially the same marking gauge 13 as in FIGS. 4 to 6, with the exception that marking is not effected by means of a prick punch 25. At the side of the door of the article of furniture, a cruciform and funnel-shaped recess 26 is provided, the intersecting point of the cross exactly defining the center of the bore 8.

The other parts of the marking gauge 13 are identical with those shown in FIGS. 4 to 6.

Figure 10:
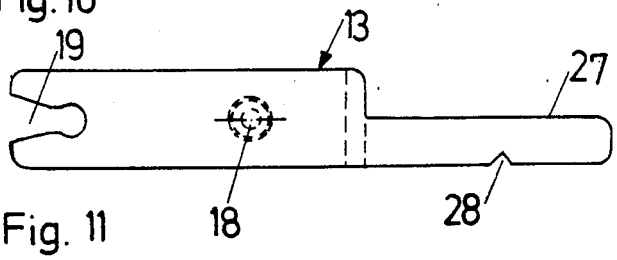
Figure 11:
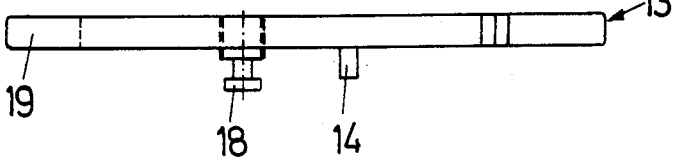
Figure 12:
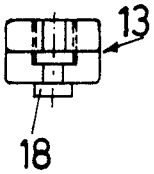

The marking gauge 13 according to FIGS. 10 and 12 differs only with respect to the means for marking the bore 8. Such means are formed by an edge 27 and a notch 28. The center point of bore 8 lies at the intersection of the line defined by edge 27 and a vertical extending through the notch 28.

FIGS. 13 to 16 are views of the marking gauge 13 according to FIGS. 1 to 3.

FIGS. 17 to 20 show a similar marking gauge 13 including prick punches 30 and 31 supported by means of security rings or retainers 26. The prick punch 30 serves to mark the bore 8 for the hinge casing 7. The prick punches 31 serve to mark the bores for fastening the mounting plate 1.

In this illustrated embodiment, a flange member 32, which is inserted into bore 8 when the bores for the mounting plate 1 are to be marked with regard to bore 8 which has already been made, is circular and continuous.

What is claimed is:

1. A marking gauge for use in locating and marking the positions of hinge elements on elements of an article of furniture, said gauge comprising:

a plate member having opposite first and second sides to be positioned on surfaces of furniture elements;

a flange extending from at least said first side of said plate member to abut an edge of one furniture element;

said plate member including locating means for positioning said plate member with respect to a hinge arm mounting plate already mounted on the one furniture element, said locating means comprising a slot in said plate member to receive a screw of the mounting plate and a bolt extending from said plate member to be received in a slot in the mounting plate, said bolt having an enlarged head; and said plate member including marking means for, upon said plate member being located with respect to a furniture element, enabling marking on a furniture element of a position for mounting thereon of a hinge element.

2. A gauge as claimed in claim 1, wherein said bolt extends from said first side of said plate member.

3. A gauge as claimed in claim 1, wherein said bolt is threaded into said plate member.

4. A gauge as claimed in claim 1, wherein said plate member has extending from both said first and second sides thereof respective said flanges.

5. A gauge as claimed in claim 1, wherein said marking means comprises at least one marking punch slidably extending through said plate member.

6. A gauge as claimed in claim 1, wherein said marking means comprises at least one recess extending through said plate member.

7. A gauge as claimed in claim 6, wherein said recess has funnel-shaped side walls.

8. A gauge as claimed in claim 7, wherein said side walls are divided into sections.

9. A gauge as claimed in claim 6, wherein said recess has opposed funnel-shaped side walls.

10. A gauge as claimed in claim 6, wherein said recess is cruciform.

11. A gauge as claimed in claim 1, further comprising means, extending from said second side of said plate member, for fitting into a hinge casing bore already formed in another furniture element, said fitting means comprising flange members.

12. A gauge as claimed in claim 11, wherein said flange members are arc-shaped.

13. A gauge as claimed in claim 1, further comprising guide flanges extending from said first side of said plate member on opposite sides of said bolt.

14. A gauge as claimed in claim 1, wherein said slot is formed in a reduced thickness portion of said plate member.

15. A gauge as claimed in claim 1, wherein said slot opens on an end of said plate member.

* * * * *